United States Patent [19]

Grimm et al.

[11] Patent Number: 4,886,486

[45] Date of Patent: Dec. 12, 1989

[54] CENTRIFUGE EQUIPPED WITH A ROTOR

[75] Inventors: Ekkehard Grimm, Offenbach; Eckhard Tödteberg, Osterode, both of Fed. Rep. of Germany

[73] Assignee: Heraeus Sepatech GmbH, Osterode, Fed. Rep. of Germany

[21] Appl. No.: 296,221

[22] Filed: Jan. 12, 1989

[30] Foreign Application Priority Data

Feb. 4, 1988 [DE] Fed. Rep. of Germany ..... 3803255

[51] Int. Cl.[4] ..... B04B 5/02

[52] U.S. Cl. ..... 494/20

[58] Field of Search ..... 494/16, 20, 17, 19, 494/85, 61; 422/72; 210/781, 782

[56] References Cited

U.S. PATENT DOCUMENTS 4,010,890 3/1977 Eugene ..... 494/20
4,314,663 2/1982 Ouchi ..... 494/16
4,391,597 7/1983 Piramoon ..... 494/20
4,427,406 1/1984 Nielsen ..... 494/16

*Primary Examiner*—Robert W. Jenkins
*Attorney, Agent, or Firm*—Felfe & Lynch

[57] ABSTRACT

A centrifuge is known which has a rotor bearing a plurality of swinging buckets mounted each on two pivots and sector-shaped inserts secured in place on the axis of the rotor shaft. The inserts have substantially vertical, radially disposed supporting walls which receive the thrust of the pivots and their outer part serves as a centrifugal force-supporting surface in the operating state. Two pivots are associated with each sector-shaped insert. In order to construct a centrifuge with swinging buckets such that it will be distinguished by its simple construction and will not require adjustment of the individual components with respect to one another, a pivot is disposed on each of the two supporting walls of the insert with their free ends confronting one another.

10 Claims, 2 Drawing Sheets

CENTRIFUGE EQUIPPED WITH A ROTOR

BACKGROUND OF THE INVENTION

The present invention relates to a centrifuge equipped with a rotor bearing a plurality of swinging buckets, each hung on two pivots, and having sector-shaped inserts secured in place axially on the rotor, the inserts having radially disposed supporting walls aligned substantially vertically, which receive the thrust of the pivots, and whose radially outer part serves in the operating state as a centrifugal force-supporting surface, two pivots being associated with each sector-shaped insert.

A centrifuge of this kind is disclosed in DE Pat. No. 17 82 602. It is a centrifuge with buckets which are suspended on resilient pivots, also called holding bolts. These pivots are journaled in sector-shaped inserts having three struts extending radially from the rotor hub, which rest at their radially outer portion on a ring. Each of these inserts bears two pivots, one of these pivots being associated with a left-hand bucket and the other pivot with a right-hand bucket adjoining the insert. The individual inserts are divided into an upper and a lower half, as seen in the axial direction, with projections on the end toward the rotor hub which clip onto a cylindrical mounting on the rotor hub. The two halves of the inserts can be bolted together. In operation, the centrifuge buckets suspended at the pivots swing horizontally outward and their bottom engages the supporting ring as the rotatory speed becomes greater and the centrifugal force thus increases. The individual inserts are closed each by a cover plate which simultaneously locks the resilient pivots. To prevent the inserts and the centrifuge buckets suspended between these inserts from turning when the centrifuge is started up, the inserts must be joined nonrotatably to the supporting ring at least in the area of the latter. A centrifuge very similar in construction to the one described above is described in DE OS No. 27 49 785. The differences from the centrifuge in DE Pat. No. 17 82 602 are that the pivots on which the centrifuge buckets hang are rigid and the inserts and the buckets are surrounded by a so-called wind pot which reduces the noise when the centrifuge is running. The inserts thrust radially outwardly against the wall, which accordingly must have the same stability as a supporting ring.

The two centrifuges described above have it in common that the inserts must be secured in their position in the rotor, i.e., with respect to the supporting ring in the case of the one type of centrifuge, and with respect to the wind pot in the case of the other type. If the inserts shift even only slightly, the result may be that a centrifuge bucket will become jammed between two inserts thus imperiling proper operation. This is especially the case with a centrifuge like the one disclosed in DE OS No. 27 49 785, because throughout the entire centrifuging process, i.e., even under maximum load, all of the forces are transferred to the inserts, while a system in accordance with DE Pat. No. 17 82 602 transmits the centrifugal forces to the inserts only until the centrifuge buckets are fully swung out and their bottom is in contact with the supporting ring. For the assembly of the centrifuge, for example after the wind pot or supporting ring has been cleaned, the inserts have to be bolted back into the rotor and their spacing from one another must be adjusted in order to assure trouble-free operation.

Setting out from this state of the art, the purpose of the present invention is to devise a centrifuge with swinging buckets which is characterized by its simple construction and which does not require any adjustment of the individual components to one another.

SUMMARY OF THE INVENTION

This purpose is achieved by the fact that a pivot is disposed on each of the two supporting walls of the insert which receive the thrust and whose free ends face one another. In this manner, each insert is designed as a self-supporting part for bearing a bucket. The bucket and insert consequently constitute a unit which can be taken out of the rotor and put back in, while the supporting walls bearing the pivots remain in a fixed relationship to one another. An arrangement of this kind furthermore offers the advantage that the buckets can be quickly exchanged. Thus, the individual sector-shaped inserts can be replaced with others of a different size to correspond to the buckets suspended in them. The individual sector-shaped parts support one another laterally and, by abutting against one another, they fill the entire rotor. Securing these sector-shaped inserts in position is necessary only in the axial direction, since in the radial direction the friction between the radial outer part of the supporting walls serving as supporting surface on the one hand and a supporting ring or corresponding wall of a wind pot on the other, will suffice to set the inserts in rotation. Even an initial slippage between the sector-shaped inserts and the surfaces in contact with them on the supporting ring and hub is no threat to the safety of operation of the centrifuge, since the friction produced by the centrifugal forces increasing with rotatory speed suffices for the driving of the inserts.

For additional stiffening the supporting walls can be joined at the top to an approximately horizontal cover plate having an open bay permitting access to the mouths of the buckets when at rest. This cover plate should cover at least the radial outer portion of the tops of the supporting walls, so that this cover plate will simultaneously form an abutment or retaining surface by which the forces produced by centrifugation will be transmitted to the upper margin of a supporting ring or to the wall of a wind pot. The cover plate can be shaped so that the bottom of the bucket will be underneath the cover plate when in the outswung position.

The number of the sector-shaped inserts each containing a bucket should be four or six. But an odd number of sector-shaped inserts, which together must form a circle of 360 degrees, can be used, in which case only sectors of identical construction may be employed in order to assure symmetry and thus uniform distribution of the load over the entire circumference. In contrast, when the number of sector-shaped inserts is even, it is possible to use sectors of different size, in which case oppositely situated sector-shaped inserts must be of the same type of construction. For example, a rotor can conceivably have four sector-shaped inserts, each covering a sector of 90 degrees, or a rotor can have four sector-shaped inserts, two of which are oppositely placed and cover a sector of 110 degrees, while the other two sector-shaped inserts form sectors of 70 degrees each.

Since the supporting walls of each sector, on which the pivots are fastened to hold the centrifuge buckets, should preferably be parallel to the walls of the outswung centrifuge buckets, additional side walls may become necessary which outwardly define the sector-shaped insert and between which the supporting walls are placed. Additional gussets or walls, especially at right angles to the side walls and supporting walls disposed between them, can be provided as additional reinforcing means. If a cover plate is provided, the top of the areas between such supporting walls and side walls should be covered by it, so that a support consisting of these two walls is formed. Such crosswalls are disposed preferably in the prolongation of the axis of the pivots.

The sector-shaped inserts are made preferably by injection molding from plastic, thereby reducing the manufacturing costs and achieving inserts distinguished by low weight combined with great stiffness. To withstand and distribute the thrust of the pivots against the supporting walls, the pivots can be welded to reinforcing plates of metal cast as inserts into the supporting walls, for example.

In accordance with the invention, a centrifuge comprises a rotor having a shaft and having sector-shaped inserts secured in position in the rotor in the direction of the rotor shaft. Two pivots are associated with each sector-shaped insert. A plurality of buckets are hung each on the two pivots. The inserts have radially disposed supporting walls aligned substantially vertically which receive a thrust of the pivots and the rotor has a radially outer area which serves as a supporting surface in the operating state. One of the pivots is disposed on each of two supporting walls of the insert which receive bearing forces. The free ends of the pivots face one another.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings:

FIG. 4 is a top view of a centrifuge with a rotor in accordance with the invention having six buckets.

DESCRIPTION OF PREFERRED EMBODIMENT

Figure 1:
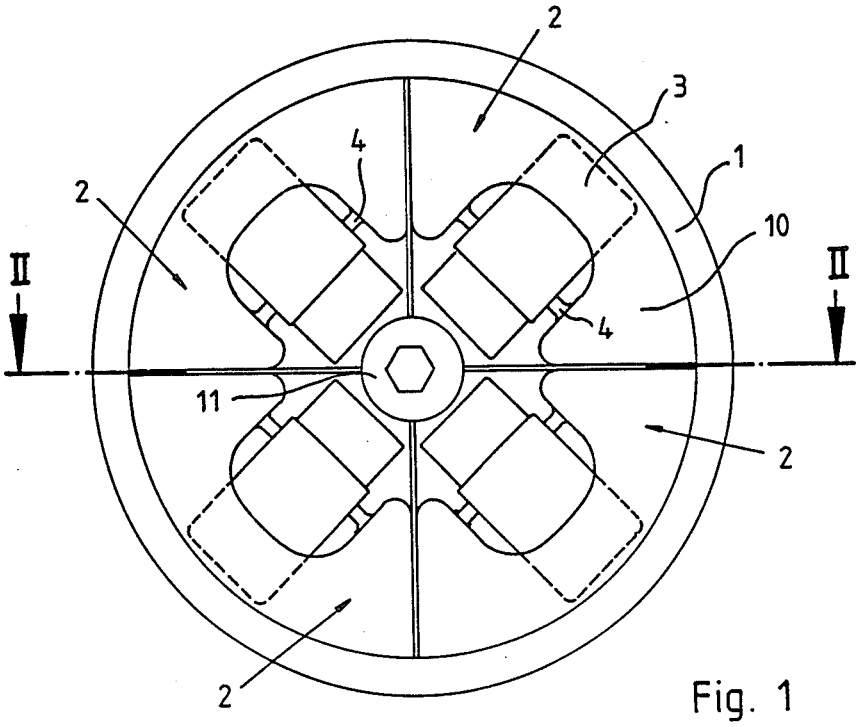
FIG. 1 is a top view of a centrifuge with a rotor in accordance with the invention having four buckets.
Figure 2:
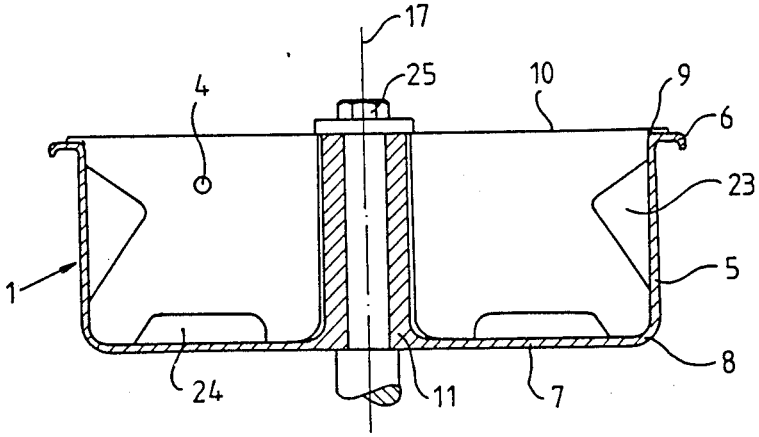
FIG. 2 is a cross section taken along line II—II in FIG. 1.

The centrifuge, of which the rotor is shown in FIG. 1, has a wind pot 1 in which four sector-shaped inserts 2 are placed, each covering a sector of 90 degrees and filling the entire wind pot. In each of the sector-shaped inserts 2 a bucket 3 is suspended on two pivots 4 such that the buckets 3 can swing freely outwardly.

The wind pot has a wall 5, a turned upper margin 6, a bottom 7 and a transition 8 between the bottom 7 and the wall 5, which has a radius so as to provide strength. The individual sector-shaped inserts 2 lie with their upper radial outer margin 9 against the turned margin 6 of the wind pot 1. The outer margin 9 is in the illustrated example formed by a cover plate 10 which extends from the margin of the sectors to the hub 11 of the rotor and covers the outer part of the sector-shaped insert 2.

Figure 3:
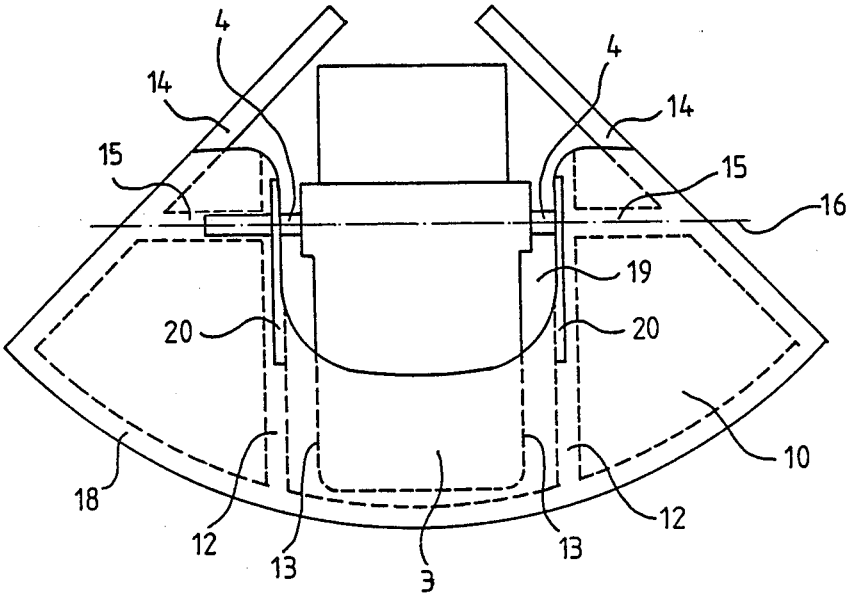
FIG. 3 is an enlarged view of a sector-shaped insert in accordance with FIG. 1.

Each sector-shaped insert 2 has two supporting walls 12, as shown in FIG. 3, which run parallel to the outside walls 13 of the bucket 3 and on which the pivots 4 are mounted. The sector-shaped insert itself is defined on its outside by two side walls 14 converging at an angle (90 degrees in the present example). Between the side walls 14 and the supporting walls 12 remains a free space which is divided by a transverse wall 15 which stiffens the sector-shaped insert 2. This transverse wall 15 preferably is in the prolongation of the pivot axis 16 of the bucket 3 which coincides with the axis of the pivots 4, so that part of the forces which are transmitted through the pivots 4 to the supporting walls 12 are applied to the transverse walls 15. Both the supporting walls 12 and the side walls 14 and the transverse wall 15 extend vertically in the direction of the axis 17 of the rotor. In the radial direction, the sector-shaped insert 2, as seen in FIG. 3, can be defined by a wall 18 or by gussets which are provided all around in the area of the transition 8, but which substantially serve the purpose of fixing the ends of the side walls 14 and of the supporting walls 12 in their distance apart from one another. The cover plate 10 completely covers the outer part of the sector-shaped insert 2 as well as the spaces between the supporting walls 12 and the side walls 15, so that the walls are joined together at their top. In the outswung state the bottom area of the buckets 3 is covered by this cover plate 10. The cover plate 10 has a bay 19 which makes the upper part of the bucket 3 freely accessible in the state of rest for loading and unloading. The sector-shaped insert, which is injection-molded from plastic, has additional reinforcing plates 20 of metal in the supporting walls 12 on which the pivots are welded in order to distribute the forces more evenly to the supporting walls 12. The pivots 4, also called hanger bolts, which consist of hardened steel, can extend through these reinforcing plates 20 so that they extend into the crosswalls 15, as shown in the case of the left pivot 4 in FIG. 3, and if desired all the way to the wall 5, so that some of the thrust will be transmitted by these extended pivots 4 directly to the wall 5.

Both the side walls 14 and the supporting walls 12 have a cutout 23 in their outer area pointing radially toward the wall 5 of the wind pot 1, so that the centrifugal forces will be introduced deliberately into the margin 6 of reinforced construction and into the transition 8. Additional cutouts 24 are provided at the bottom of the supporting walls 12 and side walls 14, but they are made mainly in order to save weight. The individual sector-shaped inserts 2 are secured by means of a bolt 25 to the hub of the rotor to prevent shifting in the direction of the axis 17. Additional fastening—for example to prevent the sector-shaped inserts from twisting radially—is not necessary.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Centrifuge comprising:

a rotor having a shaft and having sector-shaped inserts secured in position in the rotor in the direction of the rotor shaft, two pivots being associated with each sector-shaped insert, a plurality of buckets hung each on the two pivots, the inserts having radially disposed supporting walls aligned substantially vertically which receive a thrust of the pivots and the rotor having a radially outer area which serves as a supporting surface in the operating state, one of the pivots being disposed on each of two supporting walls of the insert which receive bearing forces, the free ends of the pivots facing one another.

2. Centrifuge in accordance with claim 1, in which each insert has an approximately horizontally disposed cover plate on top, which is affixed to the supporting walls and which in the state of rest allows access at least to an opening of a corresponding bucket.

3. Centrifuge in accordance with claim 2, in which the cover plate has an outer margin which constitutes in the radial direction a bearing surface.

4. Centrifuge in accordance with claim 1, in which the rotor has four sector-shaped inserts.

5. Centrifuge in accordance with claim 1, in which the rotor has six sector-shaped inserts.

6. Centrifuge in accordance with claim 1, in which each sector-shaped insert has two outer side walls between which the supporting walls are disposed.

7. Centrifuge in accordance with claim 1, in which each sector-shaped insert has side walls and has transverse walls between two supporting walls and the side walls.

8. Centrifuge in accordance with claim 1, in which the sector-shaped inserts are parts injection molded from plastic, with pivots molded therein.

9. Centrifuge in accordance with claim 8, which includes two reinforcing plates disposed in two supporting walls and in which ends of the pivots mounted on the supporting walls are joined to the reinforcing plates.

10. Centrifuge in accordance with claim 9, in which the pivots and the reinforcing plates are metal parts.

* * * * *